US008900382B2

(12) United States Patent
Johansson et al.

(10) Patent No.: US 8,900,382 B2
(45) Date of Patent: Dec. 2, 2014

(54) HOT WORKED STEEL AND TOOL MADE THEREWITH

(75) Inventors: Börje Johansson, Hagfors (SE); Odd Sandberg, Uddeholm (SE)

(73) Assignee: Uddeholm Tooling Aktiebolag, Hagfors (SE)

( * ) Notice: Subject to any disclaimer, the term of this patent is extended or adjusted under 35 U.S.C. 154(b) by 0 days.

(21) Appl. No.: 10/514,939

(22) PCT Filed: Jun. 6, 2003

(86) PCT No.: PCT/SE03/00940

§ 371 (c)(1),
(2), (4) Date: Jan. 14, 2005

(87) PCT Pub. No.: WO03/106728

PCT Pub. Date: Dec. 24, 2003

(65) Prior Publication Data

US 2005/0155674 A1 Jul. 21, 2005

(30) Foreign Application Priority Data

Jun. 13, 2002 (SE) ..... 0201799
Jan. 29, 2003 (SE) ..... 0300200

(51) Int. Cl.
*C22C 38/22* (2006.01)

(52) U.S. Cl.
USPC ..... 148/334; 420/105

(58) Field of Classification Search
USPC ..... 148/651, 547, 333, 579, 334; 420/111, 420/114, 109, 105
See application file for complete search history.

(56) References Cited

U.S. PATENT DOCUMENTS

| | | | | | |
|---|---|---|---|---|---|
| 4,279,646 | A | * | 7/1981 | Kato et al. | 420/83 |
| 4,294,613 | A | * | 10/1981 | Giflo | 420/12 |
| 4,729,872 | A | * | 3/1988 | Kishida et al. | 420/105 |
| 5,458,703 | A | * | 10/1995 | Nakai | 148/503 |
| 2004/0013559 | A1 | | 1/2004 | Sandberg et al. | |

FOREIGN PATENT DOCUMENTS

| | | | | |
|---|---|---|---|---|
| EP | 0672761 | A2 | | 9/1995 |
| EP | 0 869 196 | A2 | | 10/1998 |
| EP | 0930374 | A1 | | 7/1999 |
| GB | 1 434 891 | | | 5/1976 |
| JP | S54-022770 | B | | 8/1975 |
| JP | S52-035117 | A | | 3/1977 |
| JP | 57161051 | | | 10/1982 |
| JP | 58-117863 | | * | 7/1983 |
| JP | S59-179762 | A | | 10/1984 |
| JP | 64-011945 | | | 1/1989 |

(Continued)

OTHER PUBLICATIONS

English Translation of Ogawa et al. (JP 09-125204).*

(Continued)

*Primary Examiner* — Jessee Roe
(74) *Attorney, Agent, or Firm* — Thomas, Karceski & Karmilovich, PC

(57) ABSTRACT

The invention concerns a cold work steel having the following chemical composition in weight-%: 0.60-0.85 C from traces to 1.5 (Si+Al) 0.1-2.0 Mn 3.0-7.0 Cr 1.5-4.0 (Mo+), however max. 1.0 W 0.30-0.65 V max. 0.1 of each of Nb, Ti, and Zr max. 2.0 Co max. 2.0 Ni balance essentially only iron and unavoidable impurities.

42 Claims, 3 Drawing Sheets

(56) References Cited

FOREIGN PATENT DOCUMENTS

| | | | | |
|---|---|---|---|---|
| JP | H02-277745 | A | | 11/1990 |
| JP | 07-060314 | | | 3/1995 |
| JP | H07-316739 | A | | 12/1995 |
| JP | 8296004 | | | 11/1996 |
| JP | 09-125204 | | * | 5/1997 |
| JP | 10-273756 | | | 10/1998 |
| JP | 410273756 | | * | 10/1998 |
| JP | 11-181548 | | * | 7/1999 |
| JP | 11-193447 | | | 7/1999 |
| JP | 11-222624 | | * | 8/1999 |
| JP | 11222648 | | * | 8/1999 |
| JP | 2002241893 | | * | 8/2002 |
| WO | WO 8903898 | A1 | | 5/1989 |

OTHER PUBLICATIONS

J.T.H. Pearce, "Examination of M7C3 carbides in high chromium cast iron using thin foil transmission electron microscopy", Journal of Materials Science Letters, 2 (1983) pp. 428-432.*

Badisch, E., Mitterer, C., "Abrasive wear of high speed steels: Influence of abrasive particles and primary carbides on wear resistance", 36 (2003) pp. 765-770.*

Tatsumi, U., et al; "Cold Tool Steel Excellent in Toughness and Wear Resistance and its Production"; Daido Steel Co. Ltd.; (1999); JP11222648; JP19980034173 19980130 (Abstract).

Tatsumi, U., et al; "Cold Tool Made of Casting Excellent in Weldability and its Production"; Diado Steel Co. Ltd.; (1999); JP11181549; JP19970364849 19971222 (Abstract).

Goldshtein, M. I. Specyalnye stali, Moskva, Metallurgiya, 1985, p. 29; Goldshtein M. I. Specyalnye stali, Moskva, Metallurgiya, 1985, p. 8.

Daole, Y., et al; "Economic high speed steel"; CN1226609; Aug. 25, 1999 (Abstract).

The First Office Action dated Mar. 10, 2006, Issued in corresponding Chinese Application No. 038136481 (5 pgs).

Office Action issued May 25, 2009 for counterpart Japan Patent Application No. 2004-513533.

European Search Report, dated Dec. 29, 2009, for European Patent Application No. 03 730 978.8-2122 (4 pages).

Japanese Office Action dated Sep. 3, 2010 for Japanese Patent Application No. JP 2004-513533.

Chandrasekaran et al., "Development of machinability enhanded tool steels for improved product economy in hard milling," Technical Steel Research, 2005, Luxembourg: Office for Official Publications of the European Communities.

Nakahama et al., "The Development of High Hard and Tough Matrix Type High Speed Tool Steels," copyright 2006-2011 Matrix High Spped Steels Technology Site: http://www.matrixhighspeedsteels.com/white_paper.htm.

Wilmes and Kientopf, "Carbide Dissolution Rate and Carbide Contents in Usual High Alloyed Tool Steels at Austenitizing Temperatures Between 900° C and 1250° C," 6th International Tooling Conference, pp. 533-547.

Canadian Office Action dated Oct. 23, 2013, for corresponding Canadian Patent Application No. 2,488,793.

Canadian Office Action dated Jun. 13, 2014 in corresponding Canadian Patent Application No. 2,488,793.

* cited by examiner

Fig. 3
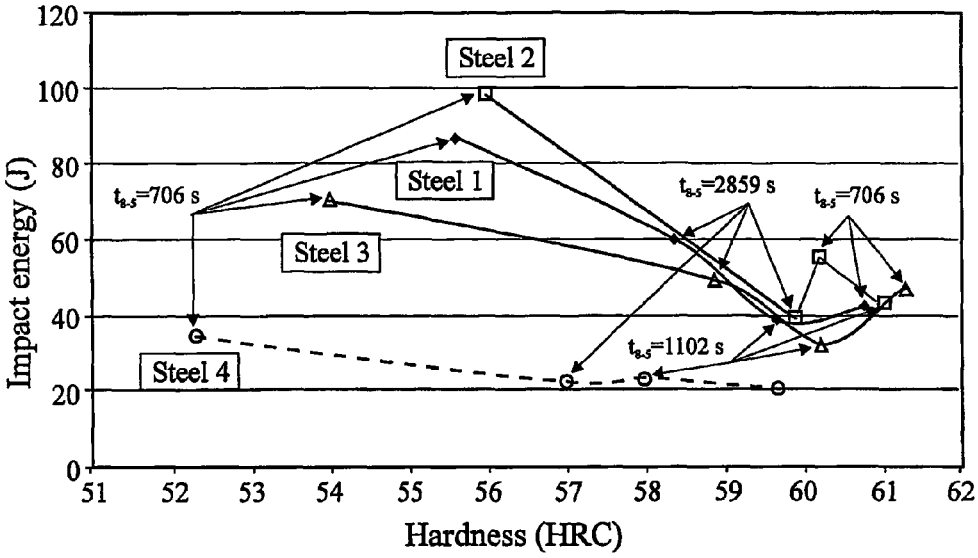
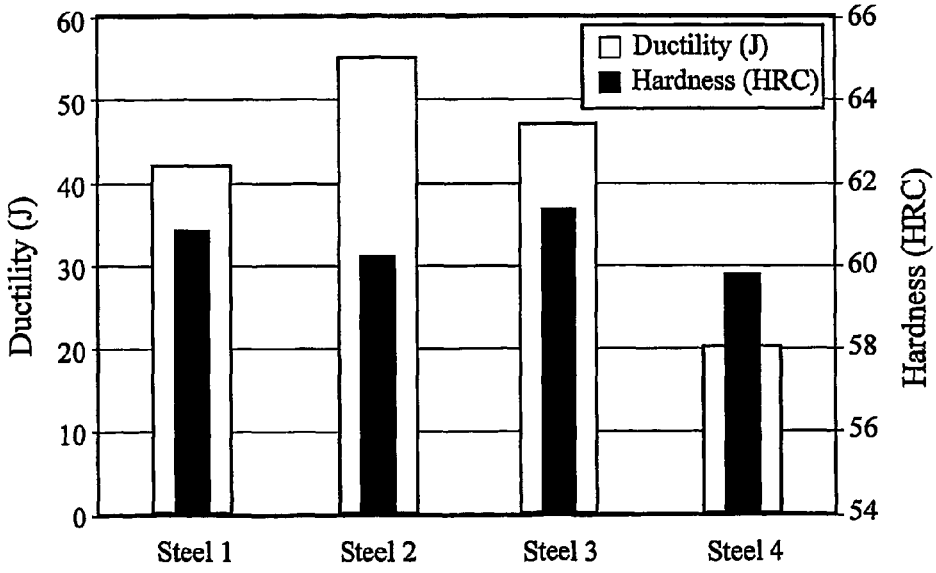
Fig. 4

HOT WORKED STEEL AND TOOL MADE THEREWITH

This application is the U.S. National Phase of International Application PCT/SE03/00940, filed 6 Jun. 2003, which designated the U.S. PCT/SE03/00940 claims priority to Swedish Application Nos. 0201799-4 filed 13 Jun. 2002, and 0300200-3 filed 29 Jan. 2003. The entire content of these applications are incorporated herein by reference.

TECHNICAL FIELD

The invention concerns a cold work steel i.e. a steel intended to be used for working materials in the cold condition of the material. Punches and dies for cold forging and other cold-pressing tools, cold-extrusion tools and thread rolling dies, but also cutting tools, e.g. knives, such as sharing knives for cutting sheet, circular cutters, and the like are typical examples of the use of the steel. The invention also concerns the use of the steel for the manufacturing of cold work tools as well as tools made of the steel.

BACKGROUND OF THE INVENTION

It is the purpose of the invention to provide a cold work steel which can be used inter alia for the above applications and which therefore should have the following features:

- Good ductility/toughness
- Good hardenability allowing through hardening in connection with conventional hardening in a vacuum furnace of products with thicknesses up to at least 300 mm,
- Adequate hardness, at least 60 HRC, after hardening and high temperature tempering, which gives a high resistance against plastic deformation and, at least as far as certain applications are concerned, also an adequate wear resistance without nitriding or surface coating with titanium carbide and/or titanium nitride or the like by means of e.g. PVD- or CVD-technique,
- Good tempering resistance in order to allow nitriding or surface coating with titanium carbide and/or titanium nitride or the like by e.g. any of said techniques without reduction of the hardness of the material, for applications which require particularly good wear resistance of the tool.

Other important product features are:

- Good dimension stability during heat treatment,
- Long fatigue life,
- Good grindability, machinability, spark machinability, and polishability.

Specifically, the invention aims at providing a matrix steel which can be employed for the above applications, i.e. a steel which is essentially void of primary carbides and which in use condition has a matrix consisting of tempered martensite.

DISCLOSURE OF THE INVENTION

The above mentioned purposes and features can be achieved by means of a steel which is characterised by what is stated in the appending patent claims.

As far as the individual elements of the steel alloy and their mutual interaction are concerned, the following applies.

The steel of the invention shall, as above mentioned, not contain any primary carbides or only an extremely low content of primary carbides, i.e. be essentially void of primary carbides, but nevertheless have a wear resistance which is adequate for most applications. This can be achieved by an adequate hardness within the range 57-63 HRC, suitably 60-62 HRC, in the hardened and high temperature tempered condition of the steel, at the same time as the steel shall have a very good toughness. In order to achieve this, the steel contains carbon and vanadium in well balanced amounts. Thus the steel contain at least 0.60%, preferably at least 0.63%, and suitably at least 0.68% C. Further the steel should contain at least 0.30%, preferably at least 0.35%, and suitably at least 0.42% V. This makes it possible that the martensitic matrix in the hardened and tempered condition of the steel will contain sufficient amount of carbon in solid solution in order to give said hardness to the matrix, and also that an adequate amount of secondarily precipitated, very small, hardness increasing vanadium carbides will be formed in the matrix of the steel. Moreover, very small, primary precipitated vanadium carbides exist in the steel, which contribute to the prevention of grain growth during the heat treatment. Any other carbides than vanadium carbides should not exist. In order to achieve said conditions, the steel must not contain more than 0.85%, preferably max. 0.80%, and suitably max. 0.78% C, while the vanadium content may amount to max. 0.65%, preferably max. 0.60%, and suitably max. 0.55%. Nominally, the steel contains 0.72% C and 0.50% V. The content of carbon in solid solution in the hardened and high temperature tempered condition of the steel nominally amounts to about 0.67%.

Silicon exists at least in a measurable amount as a residual element from the manufacturing of the steel and is present in an amount from traces up to max. 1.5%. Silicon, however, impairs the toughness of the steel and should therefore not exist in an amount exceeding 1.0%, preferably max. 0.5%. Normally, silicon exists in a minimum amount of at least 0.05%. An effect of silicon is that it increases the carbon activity in the steel and therefore contributes to affording the steel a desired hardness. Another positive effect of silicon is that it may improve the machinability of the steel. Therefore it may be advantages that the steel contains silicon in an amount of at least 0.1%. Nominally the steel contains 0.2% silicon.

Aluminium to some extent may have the same or similar effect as silicon at least in a steel of the present type. Both can be used as oxidation agents in connection with the manufacturing of the steel. Both are ferrite formers and may provide a dissolution hardening effect in the matrix of the steel. Silicon therefore may be partly replaced by aluminium up to an amount of max. 1.0%. Aluminium in the steel, however, makes it necessary that the steel is very well deoxidised and has a very low content of nitrogen, because aluminium oxides and aluminium nitrides otherwise would form, which would reduce the ductility/toughness of the steel considerably. Therefore, the steel should normally not contain more than max. 1.0% Al, preferably max. 0.3%. In a preferred embodiment, the steel contains max. 0.1% and most conveniently max. 0.03% Al.

Manganese, chromium and molybdenum shall exist in a steel in a sufficient amount in order to give the steel an adequate hardenability. Manganese also has the function of binding the extremely low contents of sulphur which may exist in the steel to form manganese sulphides. Manganese therefore, shall exist in an amount of 0.1-2.0%, preferably in an amount of 0.2-1.5%. Suitably, the steel contains at least 0.25% and max. 1.0% manganese. A nominal manganese content is 0.50%.

Chromium shall exist in a minimum amount of 3.0%, preferably at least 4.0% and suitably at least 4.5% in order to give the steel a desired hardenability when the steel contains manganese and chromium in amounts which are characteristic for the steel. Maximally, the steel may contain 7.0%, preferably max. 6.0% and suitably max. 5.5% chromium.

Also molybdenum shall exist in an adequate amount in the steel in order to afford, together with in the first place chromium, the steel a desired hardenability and also to give it a desired secondary hardening. Molybdenum in too high contents, however, causes precipitation of M6C carbides, which preferably should not exist in the steel. With this background, the steel therefore shall contain at least 1.5% and max. 4.0% Mo. Preferably, the steel contains at least 1.8% and max. 3.2% Mo, suitably at least 2.1% and max. 2.6% Mo in order that the steel shall not be caused to contain undesired M6C carbides at the cost of and/or in addition to the desired amount of MC carbides. Molybdenum in principal completely or partly may be replaced by tungsten for the achievement of a desired hardenability, but this requires twice as much tungsten as molybdenum which is a drawback. Also recirculation of scrap which is produced in connection with the manufacturing of the steel is made more difficult if the steel contains substantial contents of tungsten. Therefore, tungsten should not exist in an amount of more than max. 1.0%, preferably max. 0.3%, suitably max. 0.1%. Most conveniently, the steel should not contain any intentionally added amount of tungsten, which in the most preferred embodiment of the steel should not be tolerated more than as an impurity in the form of a residual element emanating from used raw materials for the manufacturing of the steel.

In addition to the said elements, the steel normally need not contain any further, intentionally added alloy elements. Cobalt, for example, is an element which normally is not required for the achievement of the desired features of the steel. However, cobalt may optionally be present in an amount of max. 2.0%, preferably max. 0.7%, in order to further improve the tempering resistance. Normally, however, the steel does not contain any cobalt exceeding impurity level. Another element which normally need not exist in the steel, but which optionally may be present, is nickel, in order to improve the ductility of the steel. At too high contents of nickel, however, there is a risk of formation of retained austenite. Therefore the nickel content must not exceed max. 2.0%, preferably max. 1.0%, suitably max. 0.7%. If an effective content of nickel is considered to be desired in the steel, the content e.g. may amount to 0.30-0.70%, suitably to about 0.5%. In a preferred embodiment, when it is considered that the steel has a sufficient ductility/toughness also without nickel, the steel, in relation to cost reasons, should not contain nickel in amounts exceeding that content of nickel which the steel unavoidably will contain in the form of an impurity from used raw materials, i.e. less than 0.30%.

Further, the steel in a manner per se, can optionally be alloyed with very small contents of different elements in order to improve the features of the steel in various respects, e.g. its hardenability, or for facilitating the manufacturing of the steel. For example, the steel may optionally be alloyed with boron in contents up to about 30 ppm in order to improve the hot ductility of the steel.

Other elements, on the other hand, are explicitly undesired. Thus, the steel does not contain any other strong carbide formers than vanadium. Niobium, titanium, and zirconium, for example, are explicitly undesired. Their carbides are more stabile than vanadium carbide and require higher temperature than vanadium carbide in order to be dissolved at the hardening operation. While vanadium carbides begin to be dissolved at 1000° C. and are in effect completely dissolved at 1100° C., niobium carbides do not start to be dissolved until at about 1050° C. Titanium carbides and zirconium carbides are even more stabile and do not start to be dissolved until temperatures above 1200° C. are reached and are not completely dissolved until in the molten condition of the steel. Strong carbide and nitride formers other than vanadium, particularly titanium, zirconium, and niobium, therefore must not exist in amounts above 0.1%, preferably max. 0.03%, suitably max. 0.010%. Most conveniently, the steel does not contain more than max. 0.005% of each of said elements. Also the contents of phosphorus, sulphur, nitrogen and oxygen are kept at a very low level in the steel in order to maximise the ductility and toughness of the steel. Thus, phosphorus may exist as an unavoidable impurity in a maximum amount of 0.035%, preferably max. 0.015%, suitably max. 0.010%. Oxygen may exist in a maximal amount of 0.0020% (20 ppm), preferably max. 0.0015% (15 ppm), suitably max. 0.0010% (10 ppm). Nitrogen may exist in an amount of max. 0.030%, preferably max. 0.015%, suitably max. 0.010%.

If the steel is not sulphurised in order to improve the machinability of the steel, the steel contains max. 0.03% sulphur, preferably max. 0.010% S, suitably max. 0.003% (30 ppm) sulphur. However, one may conceive to improve the machinability of the steel by intentional addition of sulphur in an amount above 0.03%, preferably above 0.10% up to max. 0.30% sulphur. If the steel is sulphurised, it may in a manner known per se also contain 5-75 ppm Ca and 50-100 ppm oxygen, preferably 5-50 ppm Ca and 60-90 ppm oxygen.

During the manufacturing of the steel, there are produced ingots or blanks having a mass exceeding 100 kg, preferably up to 10 tons and thicknesses exceeding about 200 mm, preferably up to at least 300 or 350 mm. Preferably, conventional melt metallurgical manufacturing is employed via ingot casting, suitably bottom casting. Also continuous casting may be employed, provided it is followed by recasting to desired dimensions according to above, e.g. by ESR remelting. Powder metallurgy manufacturing or spray forming are unnecessarily expensive processes and do not give any advantages which motivate the cost. The produced ingots are hot worked to desired dimensions, when also the cast structure is broken down.

The structure of the hot worked material can be normalised in different ways by heat treatment in order to optimise the homogeneity of the material, e.g. by homogenisation treatment at high temperature, suitably at 1200-1300° C. The steel is normally delivered by the steel manufacturer to the customer in the soft annealed condition of the steel; hardness about 200-230 HB, normally 210-220 HB. The tools are normally manufactured by machining operations in the soft annealed condition of the steel, but it is also conceivable per se to manufacture the tools by conventional machining operations or by spark machining in the hardened and tempered condition of the steel.

The heat treatment of the manufactured tools is normally carried out by the customer, preferably in a vacuum furnace, by hardening from a temperature between 950-1100° C., suitably at 1020-1050° C., for complete dissolution of existing carbides, for a period of time between 15 min to 2 h, preferably for 15-60 min, followed by cooling to 20-70° C., and high temperature tempering at 500-600° C., suitably at 520-560° C.

In the soft annealed condition of the steel, the steel has a ferritic matrix containing evenly distributed, small carbides, which may be of different kind. In the hardened and not tempered condition, the steel has a matrix consisting of untempered martensite. In terms of calculation by known theoretical calculations, the steel at equilibrium contains about 0.6 vol-% MC carbides. At high temperature tempering, an additional precipitation of MC carbides is obtained, which affords the steel its intended hardness. These carbides have a sub microscopic size. The amount of carbides is therefore impossible to state by conventional microscopic studies. If the temperature is increased too much, the MC carbides are caused to be more coarse and become instable, which instead causes rapidly growing chromium carbides to be established, which is not desired. For these reasons, it is important that the tempering is performed at the above mentioned temperatures and holding times as far as the alloy composition of the steel of the invention is concerned.

Further features and aspects of the invention will be apparent from the patent claims and from the following description of performed experiments and from the subsequent discussion.

BRIEF DESCRIPTION OF DRAWINGS

In the following description of performed experiments, reference will be made to the accompanying drawings, in which FIG. 1-FIG. 5 concern investigations of steels manufactured at a laboratory scale, where FIG. 3 is a chart illustrating the ductility in terms of impact toughness of examined materials versus the hardness of samples hardened in a vacuum furnace at different cooling times, FIG. 4 is a bar chart showing the ductility and the hardness of examined steel after a specific heat treatment.

DESCRIPTION OF PERFORMED EXPERIMENTS

Experiments at a Laboratory Scale

Materials

Figure 1:
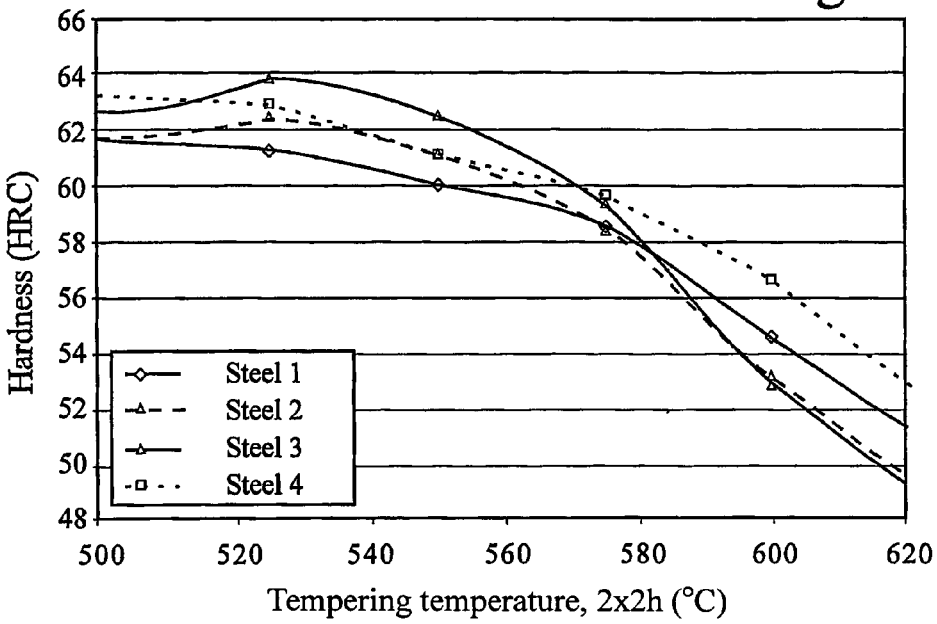
FIG. 1 is a chart illustrating the influence of the tempering temperature on the examined steels.

Four steel alloys were manufactured in the form of laboratory ingots having a mass of 50 kg. The chemical compositions are given in Table 1. The sulphur content could not be maintained at a desirably low level because of the limitations of the manufacturing technique. The content of oxygen and of other impurities than those which are given in the table have not been analysed. The following process sequence was applied: homogenisation treatment for 10 h at 1270° C./air, forging to 60×60 mm, regeneration treatment 1050° C./2 h/air, and soft annealing 850° C./2 h, cooling 10° C./h to 600° C., then free in air.

TABLE 1

Chemical composition in weight-% of materials manufactured at a laboratory scale

| Steel | C | Si | Mn | P | S | Cr | Mo | V | Ti ppm | Nb ppm | O | N ppm | Balance |
|---|---|---|---|---|---|---|---|---|---|---|---|---|---|
| 1 | 0.68 | 0.87 | 0.65 | 0.005 | 0.006 | 2.82 | 2.34 | 0.52 | 33 | <10 | n.a | 14 | Fe + other impurities |
| 2 | 0.68 | 0.19 | 0.39 | 0.004 | 0.006 | 4.93 | 2.37 | 0.37 | 29 | <10 | n.a. | 28 | Fe + other impurities |
| 3 | 0.71 | 0.90 | 0.49 | 0.004 | 0.006 | 5.09 | 2.36 | 0.56 | 39 | <10 | n.a | 19 | Fe + other impurities |
| 4 | 0.63 | 1.38 | 0.35 | 0.007 | 0.006 | 4.25 | 2.87 | 1.81 | 42 | <10 | n.a | 18 | Fe + other impurities |

n.a. = not analysed

TABLE 8

Chemical composition in weight-% (S, B and O in ppm), balance Fe and impurities, of materials manufactured at a production scale

| Steel | C | Si | Mn | P | S | Cr | Ni | Mo | W | Co | V | Ti | Nb | Cu | Al | N | B | O |
|---|---|---|---|---|---|---|---|---|---|---|---|---|---|---|---|---|---|---|
| 10 | 0.71 | 0.19 | 0.49 | .009 | 6 | 4.96 | 0.07 | 2.28 | .003 | .010 | 0.50 | .0016 | .001 | .062 | .017 | .011 | 10 | 7 |
| 11 | 0.71 | 0.19 | 0.49 | .009 | 8 | 4.98 | 0.07 | 2.30 | .003 | .011 | 0.50 | .0015 | .001 | .062 | .015 | .011 | 10 | 5 |
| 12 | 0.74 | 0.99 | 0.76 | .007 | 10 | 2.55 | 0.06 | 2.09 | .01 | .01 | 0.50 | .003 | .01 | .07 | .037 | .007 | 30 | 8 |

The above materials were examined with reference to hardness after soft annealing, micro-structure after different heat treatments, hardness after hardening and tempering, hardenability, impact toughness, wear resistance, and hot ductility. These investigations are reported in the following. Moreover, theoretical equilibrium calculations were carried out by the Thermo-Calc method with reference to the content of dissolved carbon and carbide fraction at the indicated austenitising temperature for the steels having the aimed compositions according to table 2.

TABLE 2

Chemical composition, weight-%, of Thermo-Calc-studied alloys

| Steel | C | Si | Mn | P | S | Cr | Mo | V |
|---|---|---|---|---|---|---|---|---|
| 5 | 0.72 | 1.00 | 0.75 | 0.02 | 0.005 | 2.60 | 2.25 | 0.50 |
| 6 | 0.71 | 0.20 | 0.50 | 0.02 | 0.005 | 5.00 | 2.30 | 0.55 |
| 7 | 0.74 | 1.00 | 0.50 | 0.02 | 0.005 | 5.00 | 2.30 | 0.55 |

TABLE 2-continued

| Chemical composition, weight-%, of Thermo-Calc-studied alloys | | | | | | | | |
|---|---|---|---|---|---|---|---|---|
| Steel | C | Si | Mn | P | S | Cr | Mo | V |
| 8 | 0.65 | 1.50 | 0.40 | 0.02 | 0.005 | 4.20 | 2.80 | 1.80 |

The content of dissolved carbon at the austenitising temperature, $T_A$, and vol-% MC at $T_A$ are stated in table 3 below.

TABLE 3

| | $T_A$ (° C.) | % C vid $T_A$ | vol-% MC vid $T_A$ |
|---|---|---|---|
| 5 | 1050/30 min | 0.63 | 1.01 |
| 6 | 1050/30 min | 0.65 | 0.72 |
| 7 | 1050/30 min | 0.64 | 1.04 |
| 8 | 1150/10 min | 0.38 | 2.87 |

Soft Annealed Hardness

The soft annealed hardness, Brinell hardness (HB), of the examined alloys 1-4 is given in table 4.

TABLE 4

| Soft annealed hardness | |
|---|---|
| Steel | Hardness (HB) |
| 1 | 218 |
| 2 | 208 |
| 3 | 217 |
| 4 | 222 |

Micro-Structure

The micro-structure was examined in the soft annealed condition after heat treatment to 60-61 HRC. These studies evidenced that the micro-structure in the hardened and tempered condition consisted of tempered martensite. Primary carbides occurred only in steel 4. These carbides were of type MC. Any titanium carbides, -nitrides and/or -carbonitrides were not detected in any alloy.

Hardening and Tempering

The steels 1-3 were austenitised at 1050° C./30 min and steel 4 was austenitised at 1150° C./10 min, air cooled to ambient temperature and annealed twice at different tempering temperatures, each time for 2 hours. The influence of the tempering temperature on the hardness is shown in FIG. 1. This figure indicates that the steels 2 and 3 have a potentiality to attain a desired hardness after high temperature tempering at 500-600° C., preferably at 520-560° C., suitably 520-540° C. An optimum for maximal hardness is achieved by tempering at a temperature of about 525° C. as far as the steels 2 and 3 are concerned. This is particularly important for matrix steels, which require nitriding or surface coating at a temperature in the order of 500° C. or higher for the achievement of a wear resistance which is required for certain tool applications. At these temperatures, it is thus achieved a pronounced secondary hardening due to the precipitation of MC-carbides. As is apparent from the chart in FIG. 1, a hardness exceeding 60 HRC is guaranteed by tempering even up to about 580° C., which is advantageous, because it makes it possible to perform the surface coating within a rather wide temperature range without causing the hardness of the tool to be too low. If a higher hardness is aimed at, more carbone and more carbide forming element must be added to the alloy. This, however, would cause a risk for the formation of primary carbides, which can not be dissolved by annealing. This is exemplified by steel 4, which requires a very high austenitising temperature, which causes a number of drawbacks; requirement of an unconventional hardening technique applied by the tool maker, hardening tensions, dimension changes, and risk of fissures.

Hardenability

Figure 2:
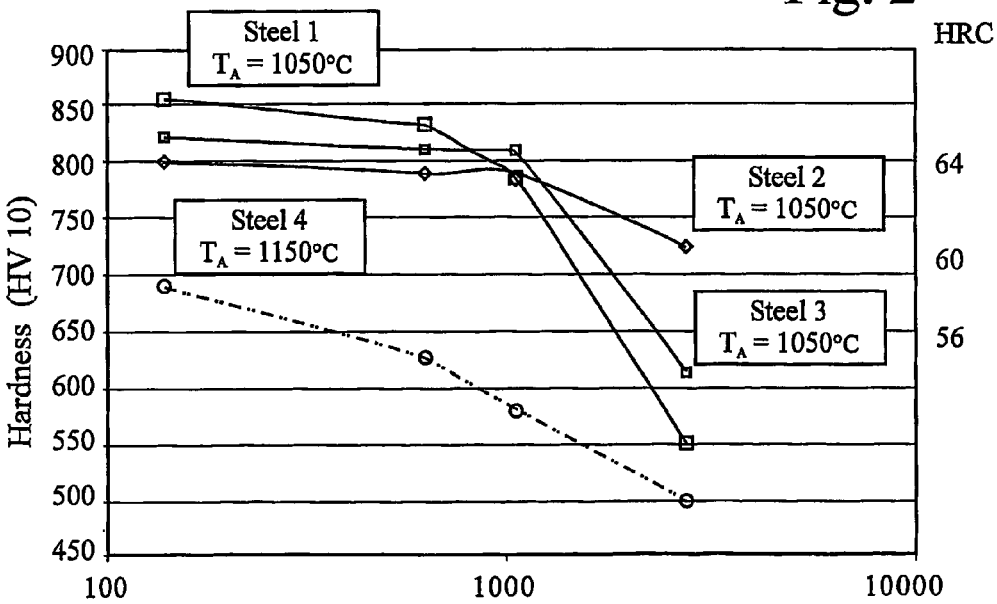
FIG. 2 is a chart illustrating the hardenability of the examined steels.

A comparison of the hardenability of the examined alloys 1-4, employing plotted data from CCT-diagrams, is shown in FIG. 2. As is shown by the diagram, steel No. 2 has the best hardenability, but also steel No. 3 has better conditions for the formation of martensite when the steel is slowly cooled from the austenitising temperature in comparison with steel No. 1 and definitely in comparison with steel No. 4.

Ductility

The ductility in terms of absorbed impact energy for unnotched test rods at 20° C., hardened in a vacuum furnace at different cooling times, and tempered to different hardnesses, is shown in FIG. 3. The best toughness, when the hardness exceeded 60 HRC was achieved for steel No. 2, and this effect was even more pronounced when the hardness exceeded 61 HRC. In order further to analyse the toughness conditions at the said hardnesses, the steels 1-4 were also compared in a bar chart, FIG. 4. In this case, the steels 1-4 were cooled from the above mentioned austenitising temperature during 706 seconds from 800° C. to 500° C., and, after continued cooling to room temperature, the steels were tempered at 525-540° C./2×2 h. FIG. 4 shows that the best toughness, when the hardnesses were comparable, was achieved with steel 2.

Hot Ductility

Figure 5:
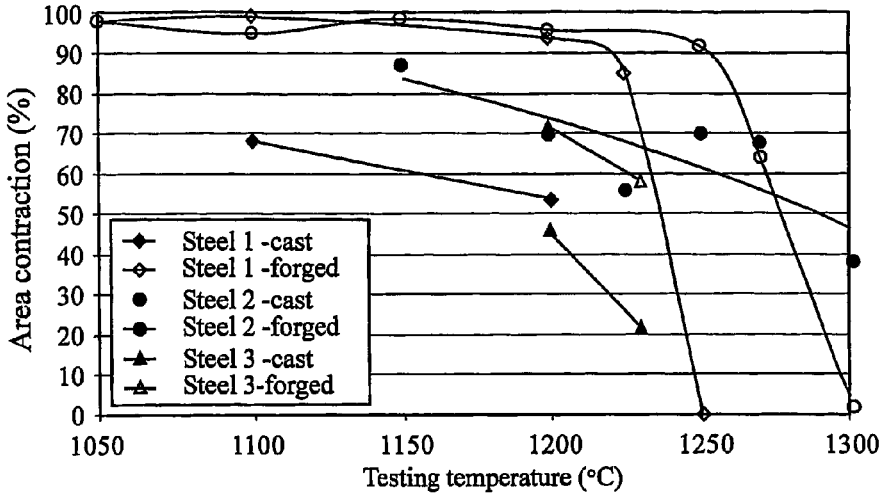
FIG. 5 is a chart illustrating the hot ductility of examined steels in the cast and forged condition, respectively, of the steel, and FIG. 6 and FIG. 7 concern examinations of steels manufactured at a production scale, where

The hot ductility is an important parameter for, among other things, the production economy of a steel. Hot ductility tests were performed after homogenisation treatment for 10 h at 1270° C./air of steels in the cast and forged condition, respectively. For the forged condition, also regeneration treatment at 1050° C./2 h and soft annealing are applied. The holding time at the test temperature was 4 min, except for steel 1 and 3 in their cast conditions, and for temperatures equal or higher than 1200° C. for forged materials. The reason for this is that these two steels were heavily oxidised, which made a correct measuring of the area contraction impossible. Steel 2, which had a low silicon content, on the other hand, did not give rise to any noteworthy oxidation. This steel also had a better hot ductility than steels No. 1 and 3 in the cast as well as in the forged conditions. About 50° C. higher test temperature could be allowed for steel 2. The results are illustrated in FIG. 5.

Abrasive Wear

The wear resistance was examined via pin-against-disc test with SiO2 as an abrasive wear agent. Steel 4 had the best wear resistance. The other steel alloys were equally good.

Discussion

Comparative studies of the examined steels were carried out for the evaluation of the above reported results. Table 5 shows the content of dissolved carbon, weight-%, and the content of MC-carbides, vol-%, at 1050° C., when equilibrium is assumed to apply for the steels 1-3 and 5-7, and at 1150° C. for the steels 4 and 8. The values of the aimed compositions of the steels 5-8 are given as a reference in the table. It is noticeable that steel 2 has a substantially lower MC-content than the intended content because the vanadium content is lower than according to the nominal composition of that steel, steel 6 which contained 0.65 vol-% MC at $T_A$.

TABLE 5

The content of dissolved carbon, weight-%, and carbon fraction, vol-%, at the indicated austenitising temperature for the examined alloys 1–4 in comparison with the aimed compositions 5–8 of these alloys.

| Steel | Optimal $T_A$ (° C.) | % C at $T_A$ | % MC at $T_A$ |
|---|---|---|---|
| 5 | 1050/30 min | 0.64 | 0.89 |
| 1 | 1050/30 min | 0.60 | 0.87 |
| 6 | 1050/30 min | 0.65 | 0.65 |
| 2 | 1050/30 min | 0.66 | 0.32 |
| 7 | 1050/30 min | 0.65 | 0.97 |

TABLE 5-continued

The content of dissolved carbon, weight-%, and carbon fraction, vol-%, at the indicated austenitising temperature for the examined alloys 1–4 in comparison with the aimed compositions 5–8 of these alloys.

| Steel | Optimal $T_A$ (° C.) | % C at $T_A$ | % MC at $T_A$ |
|---|---|---|---|
| 3 | 1050/30 min | 0.63 | 0.95 |
| 8 | 1150/30 min | 0.37 | 2.83 |
| 4 | 1150/30 min | 0.30 | 2.71 |

A comparison of the features of the examined alloys 1-4 is given in table 6. In this table the alloys have been afforded marks varying between 1-4, were 1=lowest and 4=best.

TABLE 6

Comparison of features of examined steel

| Steel No: | 1 | 2 | 3 | 4 |
|---|---|---|---|---|
| Hardenability | 2 | 4 | 3 | 1 |
| Dimension stability at heat treatment | 2 | 4 | 3 | 1 |
| Hardness after high-temperature hardening | 4 | 4 | 4 | 4 (however only after hardening from high temperature) |
| Ductilitet/Toughness | 2 | 4 | 3 | 1 |
| Wear resistance | 2 | 2 | 2 | 4 |
| Fatigue life | 4 | 4 | 4 | 2 |
| Pressure strenght | 4 | 4 | 4 | 4 |
| Grindability | 4 | 4 | 4 | 2 |
| Machineability | 4 | 3 | 4 | 2 |
| Spark machineability | 4 | 4 | 4 | 4 |
| Polishability | 4 | 4 | 4 | 3 |
| Production economy | 3 | 4 | 4 | 2 |

As is apparent from table 6, steel No. 2 has a better combination of features than the other examined and evaluated materials. Particularly, it is better as far as the most important product features are concerned. Possibly, the lower content of MC-carbides is an unfavourable aspect of steel 2, because it might reduce the resistance against grain growth. It is therefore an experience of the experiments that the vanadium content should be increased from nominally 0.40% to 0.50% in order to give a wider margin against grain growth during heat treatment. The experiments also indicate that an narrow range exists for the vanadium content for the provision of a desired resistance against grain growth without causing the carbide content to be too high with reference to the toughness of the steel and also that the carbon content should be increased to nominally 0.72% and be maintained within a rather narrow range about that content for the provision of 60-62 HRC after heat treatment. The contents of P, S, N, and O should be kept at a very low level in order to maximise ductility and toughness. Other carbide- and nitride formers such as Ti, Zr, and Nb should most conveniently be restricted to max. 0.005%. Against this background, a cold work steel according to the invention should have the nominal composition given in table 7.

TABLE 7

Nominal composition, weight-%, of a steel according to the invention, steel No. 9, and amount of dissolved C and amount of carbides, vol-%, at 1050° C.

| C | Si | Mn | P | S | Cr | Mo | V | N | O | C* | MC* vol-% |
|---|---|---|---|---|---|---|---|---|---|---|---|
| 0.72 | 0.20 | 0.50 | ≤0.010 | 0.0010 | 5.0 | 2.30 | 0.50 | ≤0.010 | ≤0.0010 | 0.67 | 0.6 |

Balance iron and anavoidable impurities

*Theoretically calculated at equilibrium according to the Thermo-Calc method.

Experiments at a Production Scale

A 65 ton production heat was manufactured in an electric arc furnace, the aimed composition of the heat corresponding to steel No. 9 according to table 7. A number of ingots were made of the molten metal, and the ingots were forged to the shape of bars having different dimensions, including bars with the dimensions Ø 330 mm and Ø 254 mm, respectively, steel No. 10 and No. 11 in table 8. In the same table, also the chemical composition of a reference material, steel No. 12, is given. That material had the shape of a forged bar with the dimension Ø 330 mm. In table 8, not only phosphorus and sulphur are impurities. Also tungsten, cobalt, titanium, niobium, copper, aluminium, nitrogen, and oxygen in the given amounts are impurities. Other impurities are not indicated but lie below allowed levels. The balance was iron.

Figure 7:
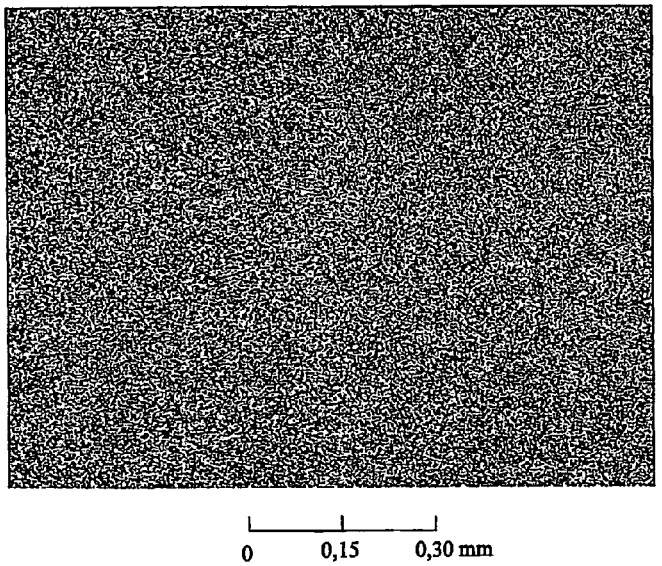
FIG. 7 shows the microstructure of a steel according to the invention after heat treatment.

Test rods were taken out from the manufactured bars. FIG. 7 shows the microstructure of the steel in a sample taken in the centre of the bar of steel No. 11. The sample was hardened by austenitising at 1025° C./30 min, air cooling and subsequently annealed at 525° C./2×2 h. As is apparent from the figure, the steel had an even microstructure consisting of tempered martensite without any primary carbides.

The ductility was investigated by impact tests performed on un-notched test rods taken from the bars in the most critical positions and the most critical direction, respectively. The test rods of steel No. 10 and No. 11 were hardened to 61.0 HRC (Rockwell hardness), and 60.5 HRC, respectively, by austenitising at 1025° C./30 min air cooling and tempering at 525° C./2×2 h. The samples of steel No. 12 were hardened to 60.2 HRC by austenitising at 1050° C./30 min, air cooling and tempering at 550° C./2×2 h. The absorbed impact energies are shown in the bar chart in FIG. 6. In the chart, the denominations CR1 and CR2 are employed, where CR1 means test rod from round bar, taken in the surface of the bar in the longitudinal direction of the bar and with the impact direction in the square direction of the bar (next most unfavourable conditions), and CR2 means test rod from round bar, taken in the centre of the bar and in other respects according to CR1 (most unfavourable conditions).

Figure 6:
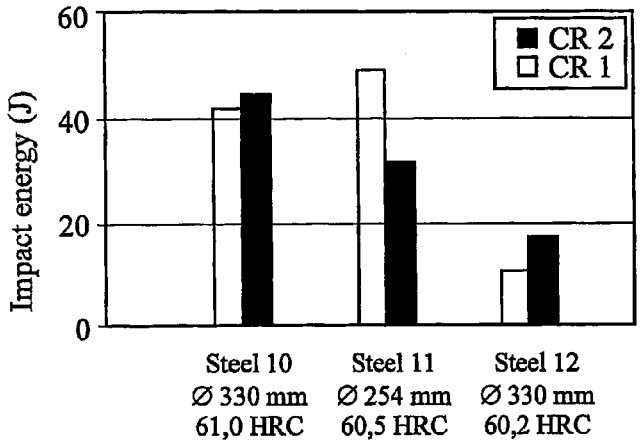
FIG. 6 illustrates the ductility of samples of examined steels, taken in some different positions in manufactured bars.

As is apparent from the diagram in FIG. 6, a superiorly much better ductility was measured for the steels according to the invention than for the reference material when the hardness of the steels of the invention were equal or even slightly higher than the hardness of the reference material, as a result of comparable impact test with un-notched, hardened and tempered samples of steels manufactured at a production scale.

The invention claimed is:

1. A hot worked matrix steel consisting of (in weight-%):
C 0.60-0.85
Si 0.05-0.5
(Si+Al) ≤0.5
Mn 0.1-2.0
Cr 4.5-5.5
Mo 1.5-2.6
W ≤1.0
(Mo+W/2) 1.5-2.6
V 0.42-0.65
Nb ≤0.1
Ti ≤0.1
Zr ≤0.1
Co ≤2.0
Ni ≤2.0
S ≤0.003
optionally, up to 30 ppm B,
balance iron and unavoidable impurities,
wherein the steel after hardening and tempering at 520-600° C. (2×2 h) has a hardness of 57-63 HRC and an un-notched impact energy in the transverse direction of 20-100 J,
wherein the steel consists of tempered martensite,
wherein the steel contains 1.04 vol. % or less of primary precipitated vanadium carbides, and
wherein the steel is void of primary carbides other than primary precipitated vanadium carbides.

2. The hot worked matrix steel according to claim 1, wherein the steel consists of at least 0.63 C.

3. The hot worked matrix steel according to claim 2, wherein the steel consists of max. 0.8 C.

4. The hot worked matrix steel according to claim 2, wherein the steel consists of max. 0.78 C.

5. A tool made from the hot worked steel according to claim 4, wherein the tool after hardening and high temperature tempering at 520-560° C., has a hardness of 60-62 HRC.

6. The hot worked matrix steel according to claim 1, wherein the steel consists of max. 0.60 V.

7. The hot worked matrix steel according to claim 1, wherein the steel consists of about 0.72 C and about 0.50 V.

8. The hot worked matrix steel according to claim 1, wherein the steel consists of at least 0.1 Si.

9. The hot worked matrix steel according to claim 1, wherein the steel consists of at least 1.8 Mo.

10. The hot worked matrix steel according to claim 9, wherein the steel consists of at least 2.1 Mo.

11. The hot worked matrix steel according to claim 9, wherein the steel consists of max. 0.1 W.

12. The hot worked matrix steel according to claim 9, wherein the steel consists of max. 0.3 W.

13. The hot worked matrix steel according to claim 12, wherein the steel consists of tungsten not exceeding impurity level.

14. The hot worked matrix steel according to claim 1, wherein the steel consists of max. 0.7 Co.

15. The hot worked matrix steel according to claim 14, wherein the steel consists of cobalt not exceeding impurity level.

16. The hot worked matrix steel according to claim 1, wherein the steel consists of max. 1.0 Ni.

17. The hot worked matrix steel according to claim 16, wherein the steel consists of max. 0.7 Ni.

18. The hot worked matrix steel according to claim 17, wherein the steel consists of nickel not exceeding impurity level.

19. The hot worked matrix steel according to claim 1, wherein the content of each of the elements titanium, zirconium, and niobium does not exceed 0.03.

20. The hot worked matrix steel according to claim 19, wherein the content of each of titanium, zirconium, and niobium does not exceed 0.01.

21. The hot worked matrix steel according to claim 19, wherein the content of each of the elements titanium, zirconium and niobium does not exceed 0.005.

22. The hot worked matrix steel according to claim 1, wherein the steel consists of not more than max. 0.035 P.

23. The hot worked matrix steel according to claim 1, wherein the steel consists of max. 20 ppm O.

24. The hot worked matrix steel according to claim 1, wherein the steel consists of max. 300 ppm N.

25. The hot worked matrix steel according to claim 1, wherein the steel has a hardness of 60-62 HRC.

26. A tool manufactured of the hot worked matrix steel according to claim 1.

27. The tool according to claim 26, wherein the tool has a hardness of 60-62 HRC.

28. The hot worked matrix steel according to claim 1, wherein the steel consists of at least 0.68 C.

29. The hot worked matrix steel according to claim 1, wherein the steel consists of max. 0.55 V.

30. The hot worked matrix steel according to claim 1, wherein the steel consists of at least 0.2 Si.

31. The hot worked matrix steel according to claim 1, wherein the steel consists of max. 0.3 Al.

32. The hot worked matrix steel according to claim 1, wherein the steel consists of max. 0.03 Al.

33. The hot worked matrix steel according to claim 1, wherein the steel consists of not more than max. 0.015 P.

34. The hot worked matrix steel according to claim 1, wherein the steel consists of not more than max. 0.010 P.

35. The hot worked matrix steel according to claim 1, wherein the steel consists of max. 10 ppm O.

36. The hot worked matrix steel according to claim 1, wherein the steel consists of max. 150 ppm N.

37. The hot worked matrix steel according to claim 1, wherein the steel consists of max. 100 ppm N.

38. The hot worked matrix steel according to claim 1, wherein the steel after hardening and high temperature tempering at 520-560° C., has a hardness of 60-62 HRC.

39. The hot worked matrix steel according to claim 1, wherein the steel has the un-notched impact energy in the transverse direction is greater than 30 J.

40. The hot worked matrix steel according to claim 1, wherein the steel has the un-notched impact energy in the transverse direction is greater than 40 J.

41. A hot worked matrix steel consisting of (in weight-%):
C 0.60-0.85
Si 0.05-0.5
(Si+Al) ≤0.5
Mn 0.1-2.0
Cr 4.5-5.5
Mo 1.5-2.6
W ≤1.0
(Mo+W/2) 1.5-2.6
V 0.42-0.65
Nb ≤0.1
Ti ≤0.1

Zr ≤0.1
Co ≤2.0
Ni ≤2.0
S ≤0.003
5-75 ppm Ca and 50-100 ppm O
optionally, up to 30 ppm B,
balance iron and unavoidable impurities,
wherein the steel after hardening and tempering at 520-600° C. (2×2 h) has a hardness of 57-63 HRC and an un-notched impact energy in the transverse direction of 20-100 J,
wherein the steel consists of tempered martensite,
wherein the steel contains 1.04 vol. % or less of primary precipitated vanadium carbides, and
wherein the steel is void of primary carbides other than primary precipitated vanadium carbides.

42. The hot worked matrix steel according to claim 41, wherein the steel consists of 5-50 ppm Ca and 60-90 ppm O.

* * * * *